US009303879B2

(12) United States Patent
Price et al.

(10) Patent No.: US 9,303,879 B2
(45) Date of Patent: Apr. 5, 2016

(54) JET PLATE FOR AIRFLOW CONTROL IN AN OVEN

(71) Applicant: Illinois Tool Works Inc., Glenview, IL (US)

(72) Inventors: Dale L. Price, Troy, OH (US); Eric A. Soller, Dayton, OH (US); Kenneth A. Gratz, Tipp City, OH (US)

(73) Assignee: ILLINOIS TOOL WORKS INC., Glenview, IL (US)

( * ) Notice: Subject to any disclaimer, the term of this patent is extended or adjusted under 35 U.S.C. 154(b) by 386 days.

(21) Appl. No.: 13/782,265

(22) Filed: Mar. 1, 2013

(65) Prior Publication Data

US 2013/0306052 A1 Nov. 21, 2013

Related U.S. Application Data

(60) Provisional application No. 61/648,166, filed on May 17, 2012.

(51) Int. Cl.

| | |
|---|---|
| ***F24C 15/00*** | (2006.01) |
| ***F24C 9/00*** | (2006.01) |
| ***F24C 15/32*** | (2006.01) |
| ***H05B 6/64*** | (2006.01) |
| ***F24C 15/16*** | (2006.01) |

(52) U.S. Cl.

CPC . *F24C 15/00* (2013.01); *F24C 9/00* (2013.01); *F24C 15/16* (2013.01); *F24C 15/325* (2013.01); *H05B 6/6485* (2013.01)

(58) Field of Classification Search

CPC ..... A21B 1/245

USPC ..... 126/21 A, 39 D; 219/400

See application file for complete search history.

(56) References Cited

U.S. PATENT DOCUMENTS

| | | | | |
|---|---|---|---|---|
| 4,279,842 | A * | 7/1981 | Belveal | 261/124 |
| 4,576,090 | A * | 3/1986 | Burtea | 99/443 C |
| 4,940,869 | A * | 7/1990 | Scholtes et al. | 219/681 |
| 6,552,305 | B2 * | 4/2003 | De'Longhi | 219/400 |
| 2008/0105135 | A1 * | 5/2008 | McFadden et al. | 99/330 |

FOREIGN PATENT DOCUMENTS

| | | | |
|---|---|---|---|
| EP | 1275275 | A1 | 1/2003 |
| EP | 1992879 | A1 | 11/2008 |
| GB | 1470408 | A | 4/1977 |
| WO | 2006099394 | A1 | 9/2006 |

OTHER PUBLICATIONS

International Search Report and Written Opinion of PCT/US2013/040705 mailed Sep. 5, 2013.

* cited by examiner

*Primary Examiner* — Avinash Savani

(74) *Attorney, Agent, or Firm* — Nelson Mullins Riley & Scarborough LLP

(57) ABSTRACT

A jet plate for directing a flow of air in a cooking chamber of an oven may include a body and a plurality of air delivery orifices. The body may be configured to be disposed along a sidewall of the cooking chamber proximate to a rack or pan support. The air delivery orifices may pass through the body. The air delivery orifices may be disposed to extend transversely across the body and may be distributed along a longitudinal length of the body such that a density of air delivery orifices proximate to one portion of the jet plate is higher than a density of air delivery orifices at another portion of the jet plate.

16 Claims, 6 Drawing Sheets

JET PLATE FOR AIRFLOW CONTROL IN AN OVEN

CROSS REFERENCE TO RELATED APPLICATIONS

This application claims the benefit of U.S. Provisional Application No. 61/648,166, filed May 17, 2012, the contents of which are incorporated herein in their entirety.

TECHNICAL FIELD

Example embodiments generally relate to ovens and, more particularly, relate to an oven that is enabled to cook food with the application of airflow within an oven cavity.

BACKGROUND

Combination ovens that are capable of cooking using more than one heating source (e.g., convection, steam, microwave, etc.) have been in use for decades. Each cooking source comes with its own distinct set of characteristics. Thus, a combination oven can typically leverage the advantages of each different cooking source to attempt to provide a cooking process that is improved in terms of time and/or quality.

In some cases, microwave cooking may be faster than convection or other types of cooking. Thus, microwave cooking may be employed to speed up the cooking process. However, a microwave typically cannot be used to cook some foods and cannot brown most foods. Given that browning may add certain desirable characteristics in relation to taste and appearance, it may be necessary to employ another cooking method in addition to microwave cooking in order to achieve browning. In some cases, the application of heat for purposes of browning may involve the use of airflow provided within the oven cavity to deliver heat to a surface of the food product. However, the provision of airflow may have a negative impact on some foods.

BRIEF SUMMARY OF SOME EXAMPLES

Some example embodiments may provide an oven that employs the provision of airflow to at least partially cook food disposed in an oven cavity. The airflow may be provided in a manner that provides different amounts of flow at different elevations within the oven from a single jet plate structure. In this regard, for example, some embodiments may provide a jet plate structure that includes air delivery orifices that are wider at a top portion than at a bottom portion thereof. For example, the air delivery orifices may have a teardrop shape with a wider portion of the teardrop oriented at a higher elevation. In some cases, the teardrop shaped air delivery orifices may further be oriented at least partially at a diagonal. Alternatively or additionally, some embodiments may be configured to provide a greater density of air delivery orifices near a front of the cooking chamber than the density at the rear of the cooking chamber in order to provide a more even volume flow distribution from front to back within the cooking chamber.

In an example embodiment, a jet plate for directing a flow of air in a cooking chamber of an oven is provided. The jet plate may include a body and a plurality of air delivery orifices. The body may be configured to be disposed along a sidewall of the cooking chamber proximate to a rack or pan support. The air delivery orifices may pass through the body. The air delivery orifices may be disposed to extend transversely across the body and may be distributed along a longitudinal length of the body such that a density of air delivery orifices proximate to one portion of the jet plate is higher than a density of air delivery orifices at another portion of the jet plate.

In another example embodiment, an oven is provided. The oven may include a cooking chamber configured to receive a food product, an air chamber configured to receive air from a fan that draws air from the cooking chamber and distribute the air along at least one sidewall of the cooking chamber, and a jet plate for directing a flow of the air into the cooking chamber. The jet plate may include a body and a plurality of air delivery orifices. The body may be configured to be disposed along a sidewall of the cooking chamber proximate to a rack or pan support. The air delivery orifices may pass through the body and be disposed to extend transversely across the body. The air delivery orifices may be distributed along a longitudinal length of the body such that a density of air delivery orifices proximate to one portion of the jet plate is higher than a density of air delivery orifices at another portion of the jet plate.

Some example embodiments may improve the cooking performance and/or improve the operator experience when cooking with an oven employing an example embodiment.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION

Figure 1:
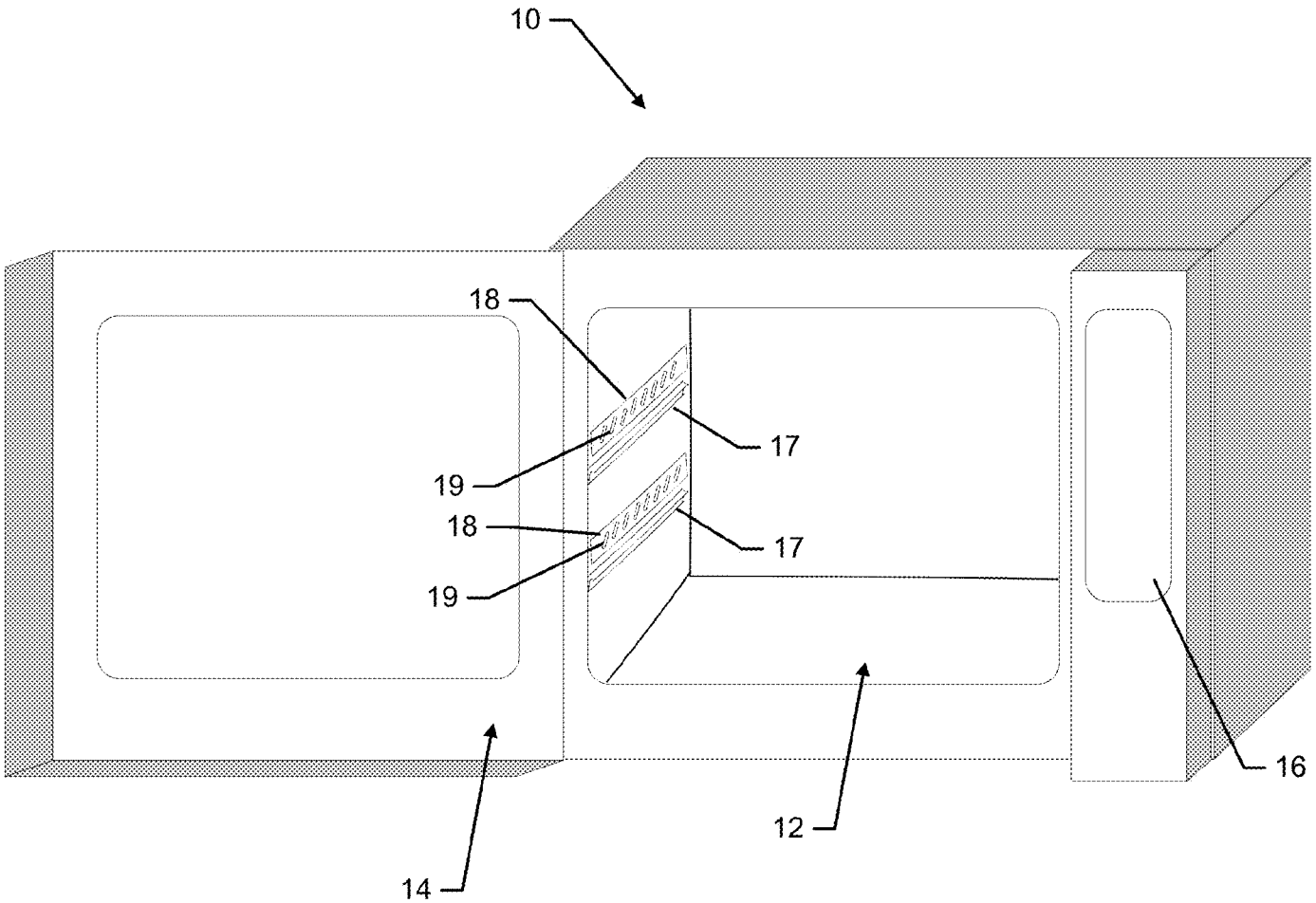
FIG. 1 illustrates a perspective view of an oven capable of employing at least two energy sources according to an example embodiment.

Some example embodiments now will be described more fully hereinafter with reference to the accompanying drawings, in which some, but not all example embodiments are shown. Indeed, the examples described and pictured herein should not be construed as being limiting as to the scope, applicability or configuration of the present disclosure. Rather, these example embodiments are provided so that this disclosure will satisfy applicable legal requirements. Like reference numerals refer to like elements throughout. Furthermore, as used herein, the term "or" is to be interpreted as a logical operator that results in true whenever one or more of its operands are true. As used herein, operable coupling should be understood to relate to direct or indirect connection that, in either case, enables functional interconnection of components that are operably coupled to each other. Furthermore, as used herein the term "browning" should be understood to refer to the Maillard reaction or other desirable food coloration reactions whereby the food product is turned brown via enzymatic or non-enzymatic processes.

Some example embodiments may improve the cooking performance of an oven and/or may improve the operator experience of individuals employing an example embodiment. In this regard, a jet plate structure may be provided that provides different amounts of flow at different elevations within the oven. Some embodiments may provide a jet plate structure that includes a plurality of air delivery orifices where each orifice is wider at a top portion thereof than at a bottom portion thereof. In some cases, the air delivery orifices may have a teardrop shape with a wider portion of the teardrop oriented at a higher elevation. The teardrop shaped air delivery orifices may be oriented such that adjacent air delivery orifices extend substantially parallel to each other. Moreover, in some cases, the parallel air deliver orifices may be provided to extend parallel to each other on a diagonal relative to the orientation of the jet plate structure itself, which may extend substantially horizontally within the oven. By providing the jet plate structure of some example embodiments, certain food products (e.g., delicate food products) may receive less airflow at lower elevations and higher airflow at higher elevations so that, for example, the ability of such food products to effectively rise while cooking may not be negatively impacted. Example embodiments may therefore assist with the provision of a properly browned, but also well finished product.

FIG. 1 illustrates a perspective view of an oven 10 according to an example embodiment. As shown in FIG. 1, the oven 10 may include a cooking chamber 12 into which a food product may be placed for the application of heat by any of at least two energy sources that may be employed by the oven 10. The cooking chamber 12 may include a door 14 and an interface panel 16, which may sit proximate to the door 14 when the door 14 is closed. In an example embodiment, the interface panel 16 may include a touch screen display capable of providing visual indications to an operator and further capable of receiving touch inputs from the operator. The interface panel 16 may be the mechanism by which instructions are provided to the operator, and the mechanism by which feedback is provided to the operator regarding cooking process status, options and/or the like.

In some embodiments, the oven 10 may include multiple racks or may include rack (or pan) supports 17 or guide slots in order to facilitate the insertion of one or more racks or pans holding food product that is to be cooked. In an example embodiment, one or more jet plates 18 may be positioned proximate to the rack supports 17 (e.g., above the rack supports in one embodiment) to enable air to be forced over a surface of food product placed in a pan or rack associated with the corresponding rack supports 17 via air delivery orifices 19 disposed in the jet plates 18. Food product placed on any one of the racks (or simply on a base of the cooking chamber 12 in embodiments where multiple racks are not employed) may be heated at least partially using radio frequency (RF) energy. Meanwhile, the airflow that may be provided may be heated to enable browning to be accomplished as described in greater detail below.

Figure 2:
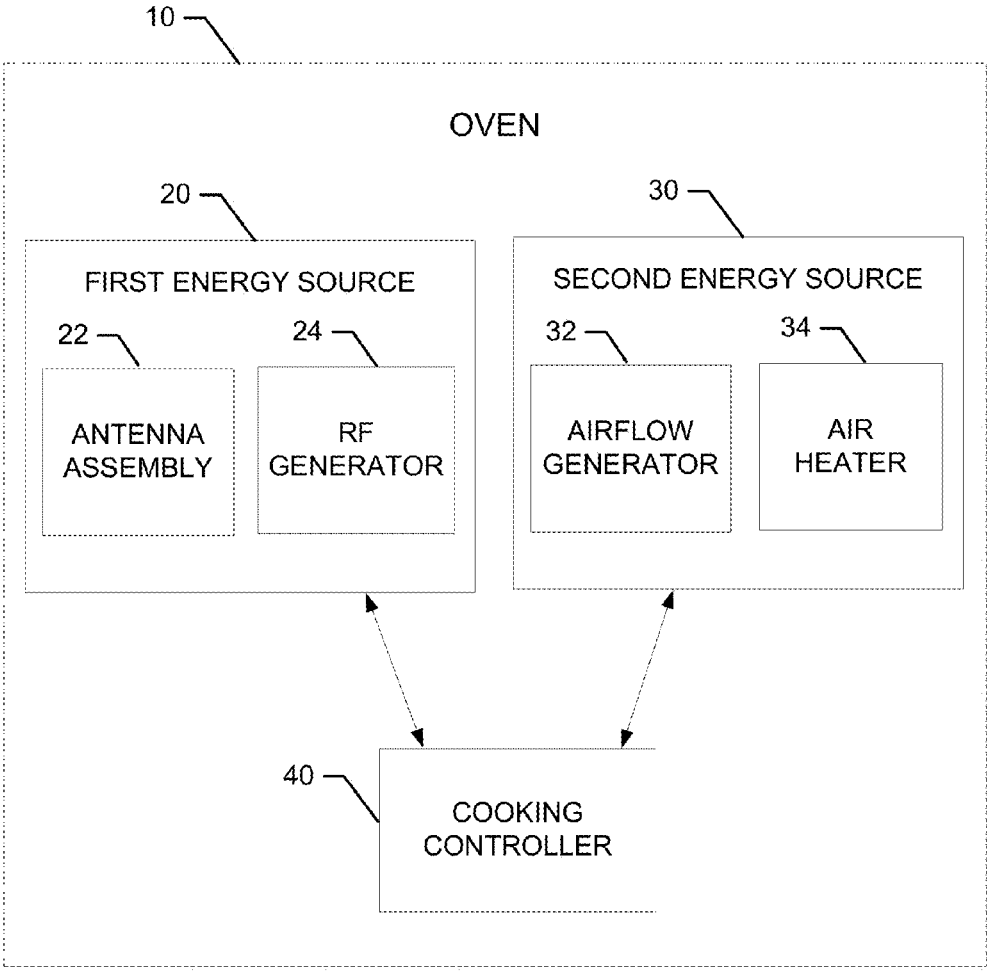
FIG. 2 illustrates a functional block diagram of the oven of FIG. 1 according to an example embodiment.

FIG. 2 illustrates a functional block diagram of the oven 10 according to an example embodiment. As shown in FIG. 2, the oven 10 may include at least a first energy source 20 and a second energy source 30. The first and second energy sources 20 and 30 may each correspond to respective different cooking methods. However, it should be appreciated that additional energy sources may also be provided in some embodiments.

In an example embodiment, the first energy source 20 may be a radio frequency (RF) energy source configured to generate relatively broad spectrum RF energy to cook food product placed in the cooking chamber 12 of the oven 10. Thus, for example, the first energy source 20 may include an antenna assembly 22 and an RF generator 24. The RF generator 24 of one example embodiment may be configured to generate RF energy at selected levels over a range of 800 MHz to 1 GHz. The antenna assembly 22 may be configured to transmit the RF energy into the cooking chamber 12 and receive feedback to indicate absorption levels of respective different frequencies in the food product. The absorption levels may then be used to control the generation of RF energy to provide balanced cooking of the food product.

In some example embodiments, the second energy source 30 may be a energy source capable of inducing browning of the food product. Thus, for example, the second energy source 30 may include an airflow generator 32 and an air heater 34. The airflow generator 32 may include a fan or other device capable of driving airflow through the cooking chamber 12 and over a surface of the food product (e.g., via the airflow slots or delivery orifices 19). The air heater 34 may be an electrical heating element or other type of heater that heats air to be driven over the surface of the food product by the airflow generator 32. Both the temperature of the air and the speed of airflow will impact browning times that are achieved using the second energy source 30.

In an example embodiment, the first and second energy sources 20 and 30 may be controlled, either directly or indirectly, by a cooking controller 40. The cooking controller 40 may be configured to receive inputs descriptive of the food product and/or cooking conditions in order to provide instructions or controls to the first and second energy sources 20 and 30 to control the cooking process. In some embodiments, the cooking controller 40 may be configured to receive static and/or dynamic inputs regarding the food product and/or cooking conditions. Dynamic inputs may include feedback data regarding absorption of RF spectrum, as described above. In some cases, dynamic inputs may include adjustments made by the operator during the cooking process. The static inputs may include parameters that are input by the operator as initial conditions. For example, the static inputs may include a description of the food type, initial state or temperature, final desired state or temperature, a number and/or size of portions to be cooked, a location of the item to be cooked (e.g., when multiple trays or levels are employed), and/or the like.

In some embodiments, the cooking controller 40 may be configured to also provide instructions or controls to the airflow generator 32 and/or the air heater 34 to control airflow through the oven 10. However, rather than simply relying upon the control of the airflow generator 32 to impact characteristics of airflow in the oven 10, some example embodiments may further employ jet plates that conform to a specific structure that is designed to provide desirable airflow characteristics as described in greater detail below.

In an example embodiment, the cooking controller 40 may be configured to access data tables that define RF cooking parameters used to drive the RF generator 24 to generate RF energy at corresponding levels and/or frequencies for corresponding times determined by the data tables based on initial condition information descriptive of the food product. As such, the cooking controller 40 may be configured to employ RF cooking as a primary energy source for cooking the food product. However, other energy sources (e.g., secondary and tertiary or other energy sources) may also be employed in the cooking process. In some cases, programs or recipes may be provided to define the cooking parameters to be employed for each of multiple potential cooking stages that may be defined for the food product and the cooking controller 40 may be configured to access and/or execute the programs or recipes. In some embodiments, the cooking controller 40 may be configured to determine which program to execute based on inputs provided by the user. In an example embodiment, an input to the cooking controller 40 may also include browning instructions. In this regard, for example, the browning instructions may include instructions regarding the air speed, air temperature and/or time of application of a set air speed and temperature combination. The browning instructions may be provided via a user interface as described in greater detail below.

Figure 3:
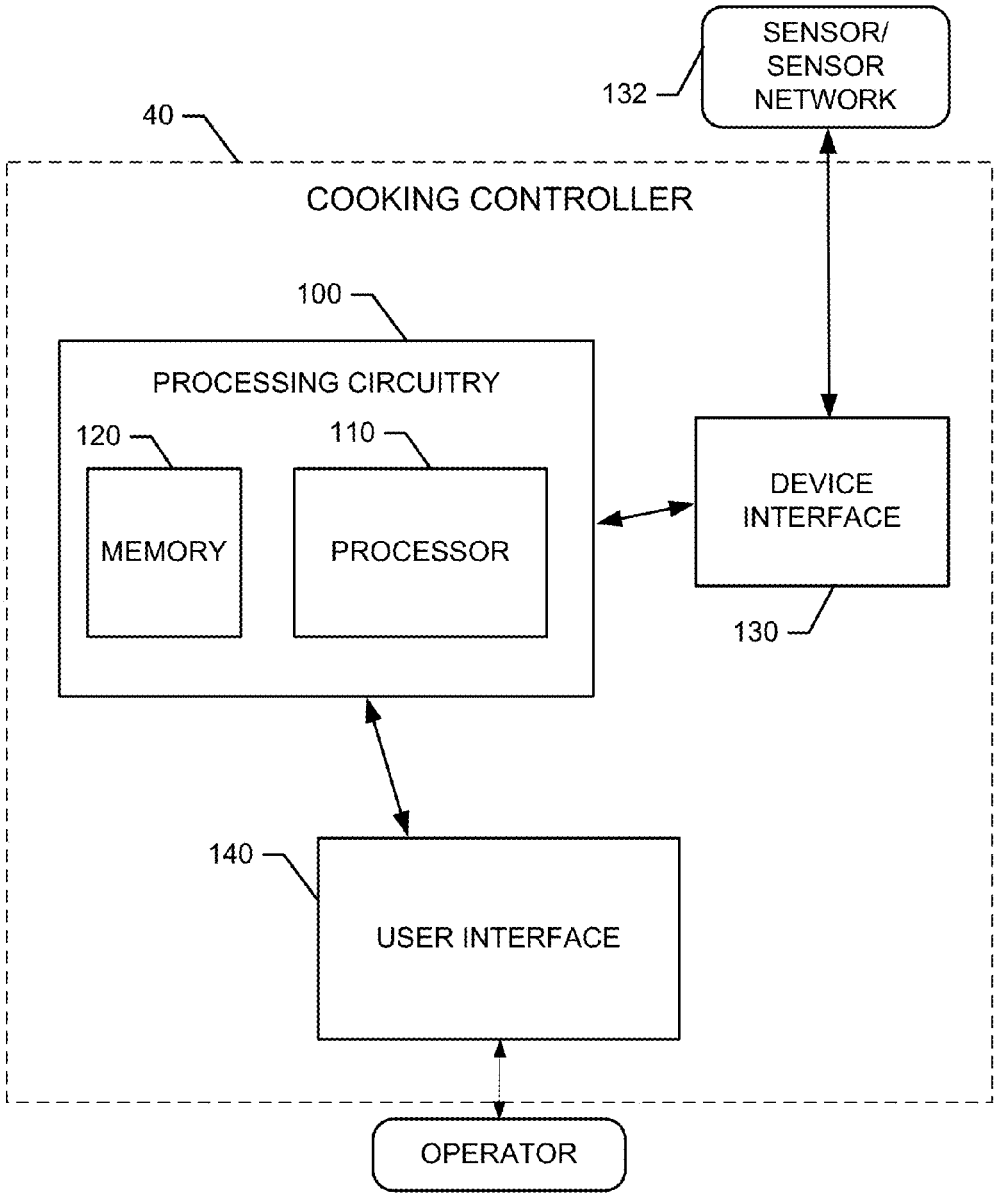
FIG. 3 illustrates a block diagram of a cooking controller according to an example embodiment.

FIG. 3 illustrates a block diagram of the cooking controller 40 according to an example embodiment. In some embodiments, the cooking controller 40 may include or otherwise be in communication with processing circuitry 100 that is configurable to perform actions in accordance with example embodiments described herein. As such, for example, the functions attributable to the cooking controller 40 may be carried out by the processing circuitry 100.

The processing circuitry 100 may be configured to perform data processing, control function execution and/or other processing and management services according to an example embodiment of the present invention. In some embodiments, the processing circuitry 100 may be embodied as a chip or chip set. In other words, the processing circuitry 100 may comprise one or more physical packages (e.g., chips) including materials, components and/or wires on a structural assembly (e.g., a baseboard). The structural assembly may provide physical strength, conservation of size, and/or limitation of electrical interaction for component circuitry included thereon. The processing circuitry 100 may therefore, in some cases, be configured to implement an embodiment of the present invention on a single chip or as a single "system on a chip." As such, in some cases, a chip or chipset may constitute means for performing one or more operations for providing the functionalities described herein.

In an example embodiment, the processing circuitry 100 may include a processor 110 and memory 120 that may be in communication with or otherwise control a device interface 130 and, a user interface 140. As such, the processing circuitry 100 may be embodied as a circuit chip (e.g., an integrated circuit chip) configured (e.g., with hardware, software or a combination of hardware and software) to perform operations described herein. However, in some embodiments, the processing circuitry 100 may be embodied as a portion of an on-board computer.

The user interface 140 (which may be embodied as, include, or be a portion of the interface panel 16) may be in communication with the processing circuitry 100 to receive an indication of a user input at the user interface 140 and/or to provide an audible, visual, mechanical or other output to the user (or operator). As such, the user interface 140 may include, for example, a display (e.g., a touch screen), one or more hard or soft buttons or keys, and/or other input/output mechanisms. In some embodiments, the user interface 140 may be provided on a front panel (e.g., positioned proximate to the door 14), on a portion of the oven 10.

The device interface 130 may include one or more interface mechanisms for enabling communication with other devices such as, for example, sensors of a sensor network (e.g., sensor/sensor network 132) of the oven 10, removable memory devices, wireless or wired network communication devices, and/or the like. In some cases, the device interface 130 may be any means such as a device or circuitry embodied in either hardware, or a combination of hardware and software that is configured to receive and/or transmit data from/to sensors that measure any of a plurality of device parameters such as frequency, temperature (e.g., in the cooking chamber 12 or in air passages associated with the second energy source 30), air speed, and/or the like. As such, in one example, the device interface 130 may receive input at least from a temperature sensor that measures the air temperature of air heated (e.g., by air heater 34) prior to introduction of such air (e.g., by the airflow generator 32) into the cooking chamber 12. Alternatively or additionally, the device interface 130 may provide interface mechanisms for any devices capable of wired or wireless communication with the processing circuitry 100.

In an exemplary embodiment, the memory 120 may include one or more non-transitory memory devices such as, for example, volatile and/or non-volatile memory that may be either fixed or removable. The memory 120 may be configured to store information, data, applications, instructions or the like for enabling the cooking controller 40 to carry out various functions in accordance with exemplary embodiments of the present invention. For example, the memory 120 could be configured to buffer input data for processing by the processor 110. Additionally or alternatively, the memory 120 could be configured to store instructions for execution by the processor 110. As yet another alternative, the memory 120 may include one or more databases that may store a variety of data sets responsive to input from the sensor network, or responsive to programming of any of various cooking programs. Among the contents of the memory 120, applications may be stored for execution by the processor 110 in order to carry out the functionality associated with each respective application. In some cases, the applications may include control applications that utilize parametric data to control the application of heat by the first and second energy sources 20 and 30 as described herein. In this regard, for example, the applications may include operational guidelines defining expected browning speeds for given initial parameters (e.g., food type, size, initial state, location, and/or the like) using corresponding tables of temperatures and air speeds. Thus, some applications that may be executable by the processor 110 and stored in memory 120 may include tables plotting air speed and temperature to determine browning times for certain levels of browning (e.g., light, medium, heavy or any other level delineations that may be provided to describe a spectrum of possible browning characteristics that may be achieved).

The processor 110 may be embodied in a number of different ways. For example, the processor 110 may be embodied as various processing means such as one or more of a microprocessor or other processing element, a coprocessor, a controller or various other computing or processing devices including integrated circuits such as, for example, an ASIC (application specific integrated circuit), an FPGA (field programmable gate array), or the like. In an example embodiment, the processor 110 may be configured to execute instructions stored in the memory 120 or otherwise accessible to the processor 110. As such, whether configured by hardware or by a combination of hardware and software, the processor 110 may represent an entity (e.g., physically embodied in circuitry—in the form of processing circuitry 100) capable of performing operations according to embodiments of the present invention while configured accordingly. Thus, for example, when the processor 110 is embodied as an ASIC, FPGA or the like, the processor 110 may be specifically configured hardware for conducting the operations described herein. Alternatively, as another example, when the processor 110 is embodied as an executor of software instructions, the instructions may specifically configure the processor 110 to perform the operations described herein.

In an example embodiment, the processor 110 (or the processing circuitry 100) may be embodied as, include or otherwise control the cooking controller 40. As such, in some embodiments, the processor 110 (or the processing circuitry 100) may be said to cause each of the operations described in connection with the cooking controller 40 by directing the cooking controller 40 to undertake the corresponding functionalities responsive to execution of instructions or algorithms configuring the processor 110 (or processing circuitry 100) accordingly. As an example, the cooking controller 40 may be configured to control air speed, temperature and/or the time of application of heat based on browning characteristics input at the user interface 140. In some examples, the cooking controller 40 may be configured to make adjustments to temperature and/or air speed based on the browning time selected. Alternatively, the cooking controller 40 may be enabled to make adjustments to browning time based on the adjustment of either or both of the temperature and air speed.

Furthermore, in some example embodiments, the cooking controller 40 may be configured to determine a cooking impact that heat addition associated with browning may provide to an already calculated cook time associated with another energy source (e.g., the first energy source 20). Thus, for example, if a cook time is determined for cooking relative to heating applied by the first energy source 20, and adjustments or inputs are made to direct usage of the second energy source 30 for browning, the cooking controller 40 may be configured to calculate adjustments (and apply such adjustments) to the cooking time of the first energy source 20 in order to ensure that the browning operation does not overcook or overheat the food product.

Figure 4:
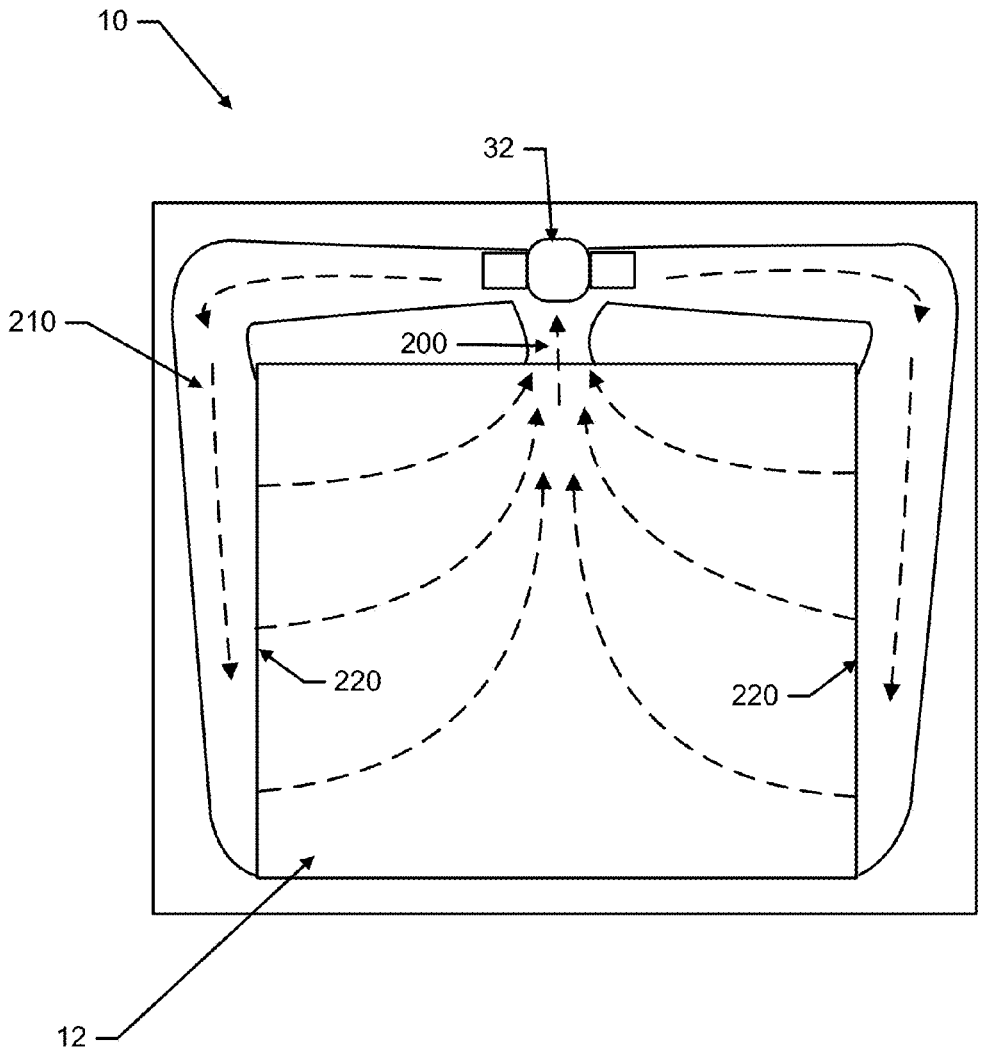
FIG. 4 illustrates a top view of a generic structure for delivery of airflow to a cooking chamber of an oven according to an example embodiment.

FIG. 4 illustrates a top view of a generic structure for delivery of airflow to a cooking chamber of an oven according to an example embodiment. As shown in FIG. 4, the airflow generator 32 (e.g., a fan) may be relatively centrally located at a rear portion of the oven 10 to draw air from the cooking chamber 12 of the oven 10 through an input duct 200. The input duct 200 of some embodiments may include one or more grease filters disposed at some portion(s) of the input duct 200 to prevent grease or other material from reaching the airflow generator 32. Air drawn into the airflow generator 32 may be distributed to an air chamber 210 that may extend laterally outward from the airflow generator 32 along a back wall of the cooking chamber 12 to further extend along an entirety or at least a portion of sidewalls 220 of the cooking chamber where air delivery orifices or slots (e.g., air delivery orifice 19) in one or more jet plates (e.g., jet plate 18) may enable the air to be forced back into the cooking chamber 12. The air chamber 210 may be tapered as it extends toward a front of the oven 10 (as shown in FIG. 4). However, in other embodiments a tapered shape may not be employed. The air chamber 210 may employ baffles and/or other structures to direct airflow such that a relatively consistent flow of air out of the jet plates/air delivery orifices is achieved both near a forward portion of the sidewalls 220 and a rear portion of the sidewalls 220. A generic representation of air flows in the oven 10 is shown using dashed lines. However, since FIG. 4 illustrates a top view, it should be appreciated that FIG. 4 generally shows the flow of air in a horizontal plane at which a set of slots in the sidewalls 220 of the oven 10 is located.

As indicated above, the oven 10 of some example embodiments may further employ jet plates (e.g., jet plate 18) that include airflow slots (i.e., air delivery orifices 19) to deliver air into the cooking chamber 12 from the air chamber 210. The jet plates may be fastenable (e.g., via screws, snap or other interference fittings, adhesives, welds and/or the like) to portions of the sidewall 220 at which larger apertures connecting the air chamber 210 and the cooking chamber 12 are located. As such, the jet plates may cover the apertures and may restrict the provision of airflow into the cooking chamber 12 to pathways provided by airflow slots provided in the jet plates. As shown in FIG. 1, the jet plates may be disposed proximate to the racks or pans that may be held in the rack supports 17. Furthermore, in some embodiments, the jet plates may extend substantially parallel to the direction of extension of the plane in which the pans, racks and/or rack supports 17 lie. The jet plates may further be disposed above each of the rack supports 17 so that airflow may be pushed over food disposed on the racks or in pans held by the rack supports 17 of FIG. 1.

Figure 5:
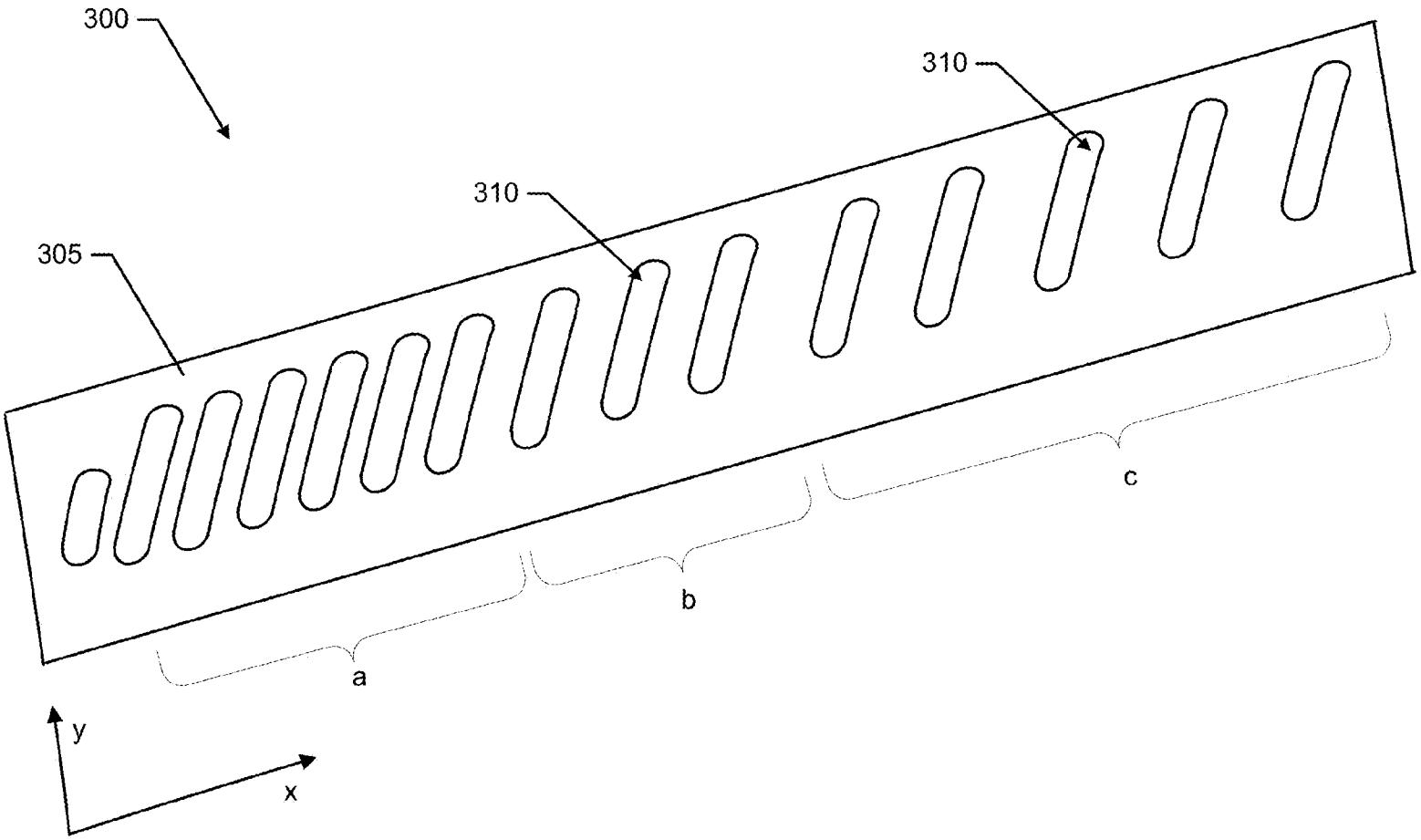
FIG. 5 illustrates a perspective view of a jet plate having a body that may take the form of a rectangular plate of any suitable type of material according to an example embodiment.

In order to provide a relatively uniform volume of airflow within the cooking chamber, some embodiments may employ air delivery orifices that are provided with decreasing density as the distance from the front of the cooking chamber 12 increases. FIG. 5 illustrates an example of such a jet plate. In this regard, FIG. 5 illustrates a perspective view of a jet plate 300 having a body 305 that may take the form of a rectangular plate of any suitable type of material. However, any desirable shape for the body 305 including irregular shapes, could be employed in some cases. In an example embodiment, the body 305 may be a removable plate, or may be an integrally formed portion of the sidewalls of the cooking chamber 12. The body 305 may have a relatively thin profile and a substantially longer longitudinal length than transverse length. The longitudinal length may extend over a majority of the length of the cooking chamber 12 from front to back.

The jet plate 300 may further include air delivery orifices 310 provided in the body 305 to pass completely through the body 305. In this example, the air delivery orifices 310 are slots provided in the jet plate 300 such that the air delivery orifices 310 are distributed along a longitudinal length of the jet plate 300. The air delivery orifices 310 are defined as symmetrical slots that lie substantially parallel to each other and extend from a lower elevation toward a higher elevation within the oven. The y-axis in FIG. 5 is indicative of elevation extending from a lower elevation to a higher elevation transversely across the body 305. The x-axis extends along the longitudinal length of the body 305 from the front of the oven 10 toward the back of the oven 10. In an example embodiment, the x-axis may lie parallel to a top and bottom of the cooking chamber 12 and/or to any pan or rack held within the cooking chamber 12. Although not required, the air delivery orifices 310 of FIG. 5 are disposed to extend diagonally from the lower elevation toward the higher elevation (i.e., transversely across the body 305 at a diagonal).

If the air delivery orifices 310 of FIG. 5 were each equidistant from each other, it could be expected that the air pushed through the air delivery orifices 310 and into the cooking chamber 12 would have a higher volume of flow at a rear portion of the cooking chamber 12 than at the front of the cooking chamber 12. Accordingly, some example embodiments may provide for a decrease in density of the air delivery orifices 310 as the jet plate 300 extends toward a rear of the oven 10. The reduced density near the rear of the oven 10 may provide for decreased volume of flow at the rear of the cooking chamber 12 and the increased density near the front of the oven 10 may provide for increased volume of flow at the front of the cooking chamber 12. Accordingly, a more balanced overall volume of flow within the cooking chamber 12 may be achieved.

In the example of FIG. 5, the density of air delivery orifices 310 may be constant within each one of a plurality of predefined regions (e.g., regions a, b and c). However, the density of air delivery orifices 310 within each region may be different than the density of air delivery orifices 310 in each other region. Moreover, the region with the highest density of air delivery orifices 310 (i.e., region a) may be disposed near the front of the cooking chamber 12, while the region with the lowest density of air delivery orifices 310 (i.e., region c) may be disposed proximate to a rear of the cooking chamber 12. Meanwhile, region b, which has a density of air delivery orifices 310 that is in between the densities in regions a and b, is disposed in between regions a and b. As an alternative to providing defined regions with different densities of air delivery orifices 310 in each region, some embodiments may simply place adjacent air delivery orifices 310 close to each other as the distance from the front of the cooking chamber 12 increases.

Figure 6:
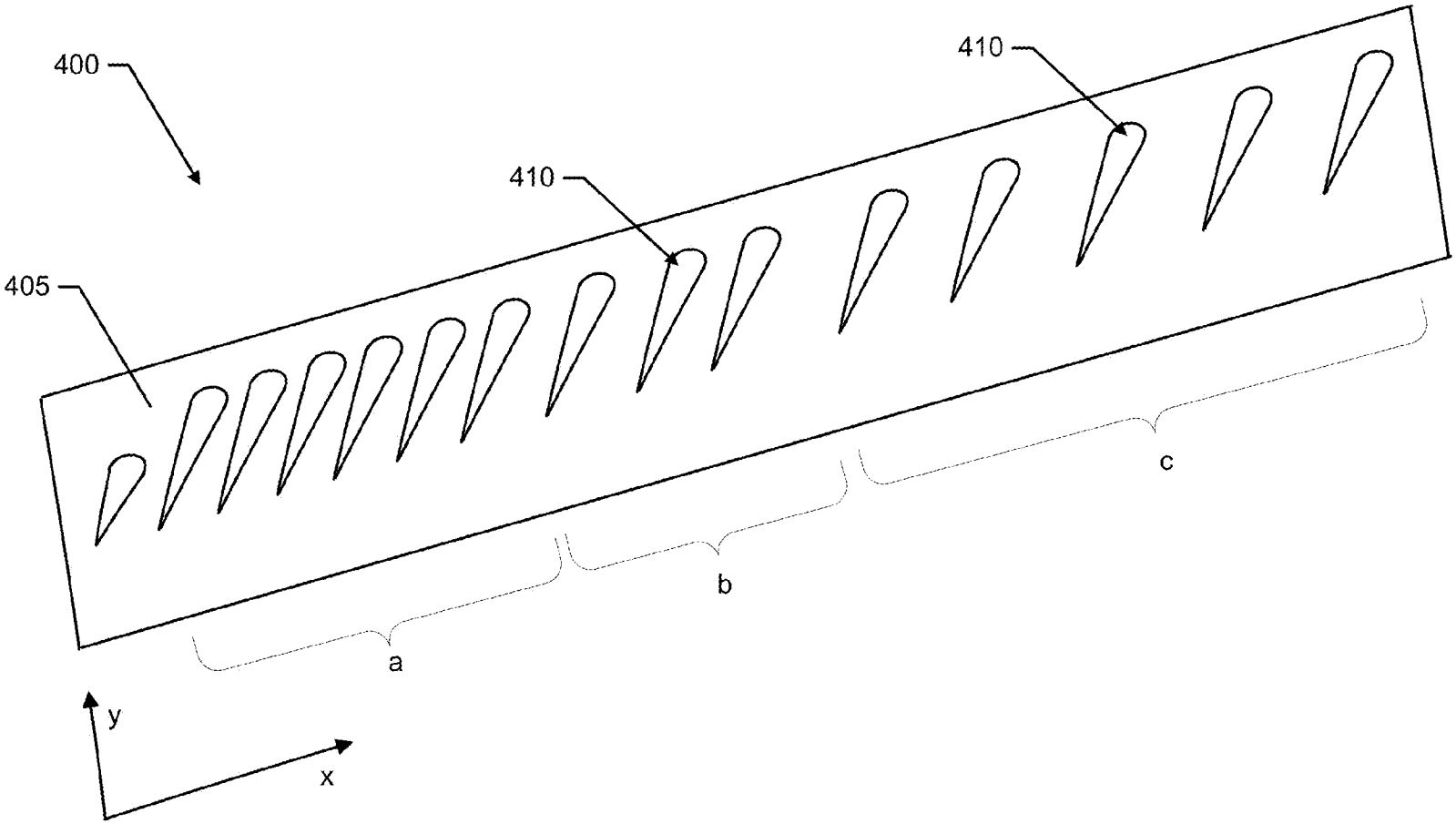
FIG. 6 illustrates an example of a jet plate that is configured to provide different volume flow rates based on elevation according to an example embodiment.

The example embodiment of FIG. 5 may provide a more uniform volume of flow in both front and rear regions of the cooking chamber 12. However, in some cases, given that the width of each one of the air delivery orifices 310 is substantially equal over the range of elevations covered by the air delivery orifices 310, the volume of air flow may also be relatively uniform horizontally within a region proximate to the pan or rack on which food product is disposed. In some cases, this type of horizontally uniform airflow volume distribution may cause too much impingement on some food products at a local level. For example, as a muffin begins to rise while cooking, the impingement on the rising batter may cause excessive browning or burning of some portions of the edge of the top of the muffin. To improve the finishing of the muffin, it may be desirable to have different flow volumes introduced at different elevations. Thus, for example, in some embodiments it may be desirable to provide slots or air delivery orifices that have different widths at corresponding different elevations such that the width of the orifices increase as elevation increases. Accordingly, higher volume flow may be introduced through higher elevation portions of the air delivery orifices, and lower volume flow may be introduced into the cooking chamber through lower elevation portions of the air delivery orifices. FIG. 6 illustrates an example of a jet plate 400 that is configured to provide different volume flow rates based on elevation.

As shown in FIG. 6, the jet plate 400 includes a body 405 having a plurality of air delivery orifices 410 that are distributed according to any of the distribution strategies described above along a longitudinal length of the body 405. As such, region a may have first (higher) density, region b may have a second (lower) density, and region c may have a third (lowest) density of placement of air delivery orifices 410. Alternatively, the air delivery orifices 410 could have increasing distances therebetween as distance from the front of the oven 10 increases (e.g., as length along the x-axis increases. Moreover, the air delivery orifices 410 may extend transversely across the jet plate 400 at a diagonal. In some cases, the width of the air deliver orifice 410 (along the horizontal direction for the oven 10 or along the longitudinal length of the jet plate 400 itself) may be higher at one end (e.g., at higher elevations) than at the other end (e.g., at lower elevations). Thus, higher flow volume may be provided proximate to higher elevation portions of the jet plate 400 and lower flow volume may be provided proximate to lower elevation portions of the jet plate 400.

Accordingly, example embodiments provide a jet plate that can be disposed at a sidewall of a cooking chamber to enable air to be introduced into the cooking chamber through air delivery orifices disposed in a body of the jet plate. The body may be a substantially flat plate configured to fit adjacent to (and perhaps also flush with) the sidewall to separate the cooking chamber from an air chamber through which air is forced by a fan or other air generator. The jet plate body may extend longitudinally across the sidewall such that the longitudinal centerline of the body is substantially parallel to a plane in which a pan or rack inserted into the oven to hold food product would lie. The air delivery orifices may be disposed to extend transversely across a portion of the body parallel to each other. Moreover, the air deliver orifices may be provided such that a density of air delivery orifices proximate to one end (e.g., a front end) of the jet plate is higher than a density of air delivery orifices proximate to an opposite end of the jet plate (e.g., the back end). Accordingly, a more uniform volume of air flow may be achieved throughout front and back parts of the cooking chamber (e.g., in a horizontal plane). Some embodiments may further orient the air delivery orifices to extend diagonally from a lower elevation to a higher elevation. Some embodiments may further shape the air delivery orifices such that a width of the air delivery orifices is greater at one elevation (e.g., a higher elevation) than at another elevation (e.g., a lower elevation).

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Moreover, although the foregoing descriptions and the associated drawings describe exemplary embodiments in the context of certain exemplary combinations of elements and/or functions, it should be appreciated that different combinations of elements and/or functions may be provided by alternative embodiments without departing from the scope of the appended claims. In this regard, for example, different combinations of elements and/or functions than those explicitly described above are also contemplated as may be set forth in some of the appended claims. In cases where advantages, benefits or solutions to problems are described herein, it should be appreciated that such advantages, benefits and/or solutions may be applicable to some example embodiments, but not necessarily all example embodiments. Thus, any advantages, benefits or solutions described herein should not be thought of as being critical, required or essential to all embodiments or to that which is claimed herein. Although specific terms are employed herein, they are used in a generic and descriptive sense only and not for purposes of limitation.

That which is claimed:

1. A jet plate for directing a flow of air in a cooking chamber of an oven, the jet plate comprising:

a body configured to be disposed along a sidewall of the cooking chamber proximate to a rack or pan support, wherein the body comprises a first end disposed proximate to a front of the cooking chamber and a second end disposed proximate to a rear of the cooking chamber, wherein the front of the cooking chamber is proximate to a cooking chamber door and the rear of the cooking chamber is distal from the cooking chamber door; and a plurality of air delivery orifices that pass through the body, the air delivery orifices being disposed to extend transversely across the body, the air delivery orifices being distributed along a longitudinal length of the body from, the first end to the second end, such that a density of air delivery orifices proximate to the first end of the jet plate is higher than a density of air delivery orifices the second end of the jet plate.

2. The jet plate of claim 1, wherein the air delivery orifices are disposed diagonally to extend from a lower elevation to a higher elevation as they extend transversely across the body.

3. The jet plate of claim 2, wherein the body is a substantially rectangular shaped, flat plate disposed at the sidewall to enable air to be introduced into the cooking chamber from an air chamber.

4. The jet plate of claim 2, wherein the jet plate lies flush with the sidewall to separate the cooking chamber from an air chamber through which air is forced by an air generator.

5. The jet plate of claim 1, wherein a shape of the air delivery orifices is provided such that a width of the air delivery orifices is greater at one elevation than at another elevation.

6. The jet plate of claim 5, wherein the shape of the air delivery orifices is wider at a higher elevation and less at a lower elevation.

7. The jet plate of claim 6, wherein the air delivery orifices have a substantially teardrop shape.

8. The jet plate of claim 7, wherein the air deliver orifices are disposed diagonally to extend from a lower elevation to a higher elevation as they extend transversely across the body.

9. The jet plate of claim 1, wherein at least some of the air delivery orifices lie substantially parallel to each other.

10. An oven comprising:

a cooking chamber configured to receive a food product;

an air chamber configured to receive air from a fan that draws air from the cooking chamber and distribute the air along at least one sidewall of the cooking chamber; and a jet plate for directing a flow of the air into the cooking chamber, wherein the jet plate comprises:

a body configured to be disposed along a sidewall of the cooking chamber proximate to a rack or pan support, wherein the body comprises a first end disposed proximate to a front of the cooking chamber and a second end disposed proximate to a rear of the cooking chamber, wherein the front of the cooking chamber is proximate to a cooking chamber door and the rear of the cooking chamber is distal from the cooking chamber door; and a plurality of air delivery orifices that pass through the body, the air delivery orifices being disposed to extend transversely across the body, the air delivery orifices being distributed along a longitudinal length of the body, from the first end to the second end, such that a density of air delivery orifices proximate to the first end of the jet plate is higher than a density of air delivery orifices at the second end of the jet plate.

11. The oven of claim 10, wherein the air delivery orifices are disposed diagonally to extend from a lower elevation to a higher elevation as they extend transversely across the body.

12. The oven of claim 1, wherein the body is a substantially rectangular shaped, flat plate disposed at the sidewall to enable air to be introduced into the cooking chamber from an air chamber.

13. The oven of claim 12, wherein the jet plate lies flush with the sidewall to separate the cooking chamber from an air chamber through which air is forced by an air generator.

14. The oven of claim 10, wherein a shape of the air delivery orifices is provided such that a width of the air delivery orifices is greater at one elevation than at another elevation.

15. The oven of claim 14, wherein the shape of the air delivery orifices is wider at a higher elevation and less at a lower elevation.

16. The oven of claim 15, wherein the air delivery orifices have a substantially teardrop shape.

* * * * *